US005513619A

United States Patent [19]

Chen et al.

[11] Patent Number: 5,513,619

[45] Date of Patent: May 7, 1996

[54] DISCHARGE IGNITION APPARATUS FOR INTERNAL COMBUSTION ENGINE

[75] Inventors: Xunming Chen, Gloucester, Mass.; Philip S. Schmidt, Aiken, S.C.

[73] Assignee: R. E. Phelon Company, Inc., Aiken, S.C.

[21] Appl. No.: 380,375

[22] Filed: Jan. 30, 1995

[51] Int. Cl.[6] ..... F02P 3/06

[52] U.S. Cl. ..... 123/601; 123/600

[58] Field of Search ..... 123/600, 599, 123/652, 601; 361/256, 258, 263; 315/209 SC

[56] References Cited

U.S. PATENT DOCUMENTS

| | | | |
|---|---|---|---|
| Re. 31,837 | 2/1995 | Burson | 123/601 |
| 3,554,179 | 1/1971 | Burson . | |
| 3,623,467 | 11/1971 | Piteo . | |
| 3,861,373 | 1/1975 | Allwang et al. | 123/601 |
| 3,894,524 | 7/1975 | Burkett et al. | 123/601 |
| 3,911,887 | 10/1975 | Burson . | |
| 3,935,852 | 2/1976 | Donovan et al. . | |
| 3,960,128 | 6/1976 | Anderson et al. | 123/601 |
| 4,036,201 | 7/1977 | Burson | 123/601 |
| 4,285,321 | 8/1981 | Phelon et al. . | |
| 4,288,834 | 9/1981 | Burson | 123/601 |
| 4,399,801 | 8/1983 | Kondo et al. | 123/603 |
| 4,487,191 | 12/1984 | Piteo . | |
| 4,515,140 | 5/1985 | Enomoto et al. | 123/603 |
| 4,538,586 | 9/1985 | Miller . | |
| 4,641,627 | 2/1987 | Nash | 123/601 |

*Primary Examiner*—Raymond A. Nelli
*Attorney, Agent, or Firm*—Dority & Manning

[57] ABSTRACT

An improved capacitive discharge ignition system utilizes a permanent magnet assembly revolving in synchronism with operation of an internal combustion engine to generate spark energy. The relatively high voltage necessary to initiate an ignition spark is produced by application of a capacitive discharge voltage to the primary coil of a step-up transformer. The ignition spark is initiated in timed relationship when a voltage otherwise induced on the secondary coil of the step-up transformer by revolution of the magnet assembly exceeds a characteristic spark sustaining potential. Longer spark duration at lower engine speeds is provided by configuring the discharge circuit such that no more than a negligible current flows in the charge coil during the time in which the sustaining potential is being utilized to maintain the spark. In some exemplary constructions, the discharge voltage may be triggered by a voltage divider network electrically connected across the primary coil.

28 Claims, 3 Drawing Sheets

DISCHARGE IGNITION APPARATUS FOR INTERNAL COMBUSTION ENGINE

BACKGROUND OF THE INVENTION

The present invention generally relates to an improved ignition system for use in an internal combustion engine. More particularly, the present invention relates to a capacitive discharge ignition system which provides improved spark energy and duration when compared with systems of the prior art.

Breakerless ignition systems for small gasoline engines have generally been divided into two broad classes, i.e., inductive type and capacitive discharge ("CD") type. Each of these types includes a transformer having a primary coil and a secondary coil wound about a magnetically permeable core. A magnet assembly is provided to revolve about an axis in synchronism with operation of the engine such that its pole faces are periodically moved past opposing pole faces of the core. As a result, voltages are induced in the transformer coils.

The inductive ignitions generally include a transistor, typically a darlington transistor, connected in circuit with the primary coil. The transistor is switched "on" to provide a low impedance path for current produced by the induced voltage, then switched off to interrupt the current. The interruption of the current causes a desired higher voltage to be induced on the secondary coil, which is connected to the engine's spark plug.

While inductive ignitions are often characterized by a high energy spark of relatively long duration, CD ignitions are often preferred for economic or other considerations. Like an inductive ignition, CD ignitions also include a step-up transformer mounted to cooperate with a revolving magnet assembly. These ignitions, however, further include a charge coil connected to a capacitor. Revolution of the magnet assembly results in a charge being accumulated on the capacitor.

An electronic switch, typically a silicon controlled rectifier ("SCR"), is connected between the capacitor and the primary coil. When the electronic switch is "closed," the charge which has accumulated on the capacitor produces a flow of current through the primary coil. As a result, a higher voltage is induced across the secondary coil to produce a spark at the spark plug. A typical example of a CD ignition system is shown in U.S. Pat. No. Re. 31,837, issued to Burson and incorporated herein by reference.

To initiate a spark across the gap of a spark plug, it is necessary for the voltage to first exceed a characteristic "spark ionization potential." After the spark has been initiated, it may be maintained by a characteristic "sustaining potential," which is generally much lower than the spark ionization potential. For example, a typical spark ionization potential may have a magnitude of ten (10) kilovolts or higher, whereas sustaining potentials of 300 to 700 volts are not uncommon.

In a CD ignition, the secondary coil voltage produced by discharge of the capacitor will, by design, exceed the required spark ionization potential. Typically, however, the capacitor will discharge relatively quickly. Thus, a secondary coil voltage produced solely by capacitive discharge will be correspondingly short in duration. For example, it is not uncommon for such a "discharge voltage" to have a duration of about 200 microseconds or less.

The prior art has recognized that the voltage induced on the secondary coil by revolution of the magnet assembly may exceed the sustaining potential at certain times during the revolution cycle if certain conditions are satisfied. As a result, triggering of the electronic switch at such times may produce a spark having a longer duration than that which may be produced by capacitive discharge alone. In this case, the capacitive discharge may be utilized to initiate the spark which can then be continued by the voltage induced by revolution of the magnet. This technique, which is similar to techniques often utilized in inductive ignitions, is described for a CD ignition in U.S. Pat. No. 4,538,586, issued to Miller ("the '586 patent").

A problem with utilizing the voltage induced on the secondary coil to sustain the spark in a CD ignition, such as that described in the '586 patent, has been the engine speeds required to produce the sustaining potential. Specifically, sufficient voltage has generally been induced on the secondary coil only when the engine is operating at relatively high speeds. At lower speeds, the spark duration has remained limited to that produced by discharge of the capacitor. Thus, inductive ignitions have often been utilized when longer spark duration has been desired.

SUMMARY OF THE INVENTION

The present invention recognizes and addresses the foregoing disadvantages, and others, of prior art constructions and methods. Accordingly, it is an object of the present invention to provide an improved CD ignition system for an internal combustion engine.

It is a more particular object of the present invention to provide an improved CD ignition system which produces a longer spark duration at lower engine speeds than the prior art.

It is a further object of the present invention to provide an improved CD ignition system which produces a higher spark energy at lower engine speeds than the prior art.

It is also an object of the present invention to provide an improved gasoline engine powered device incorporating the disclosed CD ignition system.

Some of these objects are achieved by a discharge ignition apparatus for use in an internal combustion engine to produce an electrical spark at a spark ignition device, such as a spark plug. The apparatus comprises a magnet assembly operatively revolved along a circular path in synchronism with operation of the engine. A magnetically permeable core is mounted adjacent the circular path and has at least two leg portions, each including a respective end face. The leg portions are situated so that pole faces of the magnet assembly pass proximate to the end faces of the core during rotation of the magnet assembly. A transformer having a primary coil and a secondary coil situated about the core is also provided. The secondary coil is electrically connected during operation to the spark ignition device.

The apparatus further comprises a discharge circuit including an energy storage element. A charge coil is situated about the core such that a first half-cycle voltage and a second half-cycle voltage are induced thereon during rotation of the magnet assembly. An electronic switch is electrically connected between the energy storage element and the primary coil of the transformer. The electronic switch is nonconductive during the first half-cycle voltage to allow electrical energy to accumulate at the energy storage element. At a predetermined time during the second half-cycle voltage, the electronic switch is rendered conductive by a triggering signal. Triggering circuitry electrically connected to the electronic switch are provided for supplying the triggering signal thereto.

In some exemplary constructions, the triggering circuitry includes a voltage divider network electrically connected across the primary coil. Such a voltage divider network defines a divider node at which the triggering signal is produced. Preferably, the voltage produced at the divider node is at least three-fourths of the total voltage induced across the primary coil.

As noted, the discharge circuit is configured like the prior art to supply electrical energy to the energy storage element during the first half-cycle voltage. Unlike the prior art, however, a discharge circuit constructed according to the invention is further configured so that no greater than a negligible current flows through the charge coil during the second half-cycle voltage. As a result, magnetic flux which may oppose the voltage being induced on the secondary coil is less than in prior art constructions. Accordingly, the voltage induced on the secondary coil by revolution of the magnet assembly exceeds the spark sustaining potential at relatively low engine speeds.

The discharge circuit may further include a resistive element electrically connected across the charge coil. This resistive element will function to limit the maximum voltage during the second half-cycle, while simultaneously conducting a negligible current. The resistive element may have a value typically falling within a range of 10,000 ohms to 20,000 ohms.

In some exemplary constructions, the discharge circuit is configured having a first side of the primary coil electrically connected to ground potential. A second side of the primary coil is electrically connected in this case to a cathode of the electronic switch. A rectifier diode may also be provided having its anode electrically connected to one side of the charge coil. A cathode of the rectifier diode may be electrically connected to the anode of the electronic switch. In this arrangement, an anode of a return path diode may be electrically connected to the cathode of the electronic switch. The cathode of such a return path diode is electrically connected to an anode of the electronic switch.

Preferably, the energy storage element is a storage capacitor connected between the anode of the electronic switch and ground potential.

Other objects, features, and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
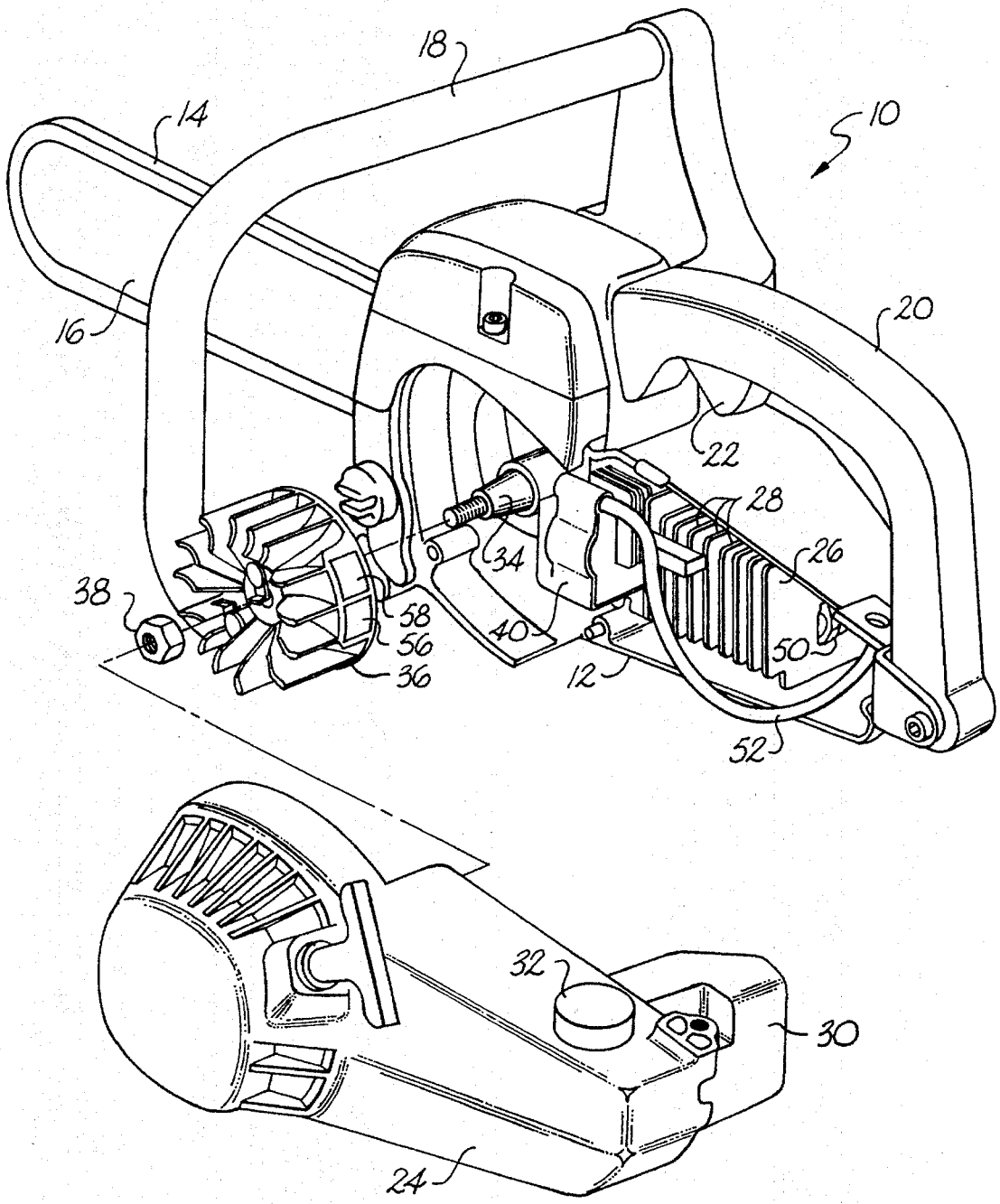
FIG. 1 is a perspective view of a chain saw in which a portion of the housing has been removed to show the gasoline engine contained therein.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only and is not intended as limiting the broader aspects of the present invention, which broader aspects are embodied in the exemplary constructions.

Referring to FIG. 1, a chain saw 10 is illustrated as being typical of a gasoline engine powered device which may be improved according to the present invention. Although a chain saw is shown for purposes of explanation, it should be appreciated that the present invention is not limited thereto, but may also be utilized with other gasoline powered devices, such as a lawn mower or a string trimmer.

As is well known, chain saw 10 includes a housing 12 containing therein a small gasoline engine. The gasoline engine within housing 12 drives a cutter chain (diagrammatically referenced as 14) which is maintained on a generally flat cutter bar 16. During use, an operator grasps handles 18 and 20 to manipulate chain saw 10 as recommended. The speed of cutter chain 14 may be controlled by actuation of throttle switch 22.

In this drawing, a portion 24 of housing 12 is removed to show certain internal components located therein. As illustrated, the engine of chain saw 10 includes a cylinder head 26, within which the piston is contained. Because the engine is air-cooled in this example, cylinder head 26 carries thereon a plurality of cooling fins 28. Also shown is a small gas tank 30 for containing fuel to run the engine. Access to gas tank 30 is provided by gas cap 32.

Operative reciprocation of the piston within cylinder head 26 causes rotation of shaft 34, which is operatively connected to flywheel 36. In this case, flywheel 36 is maintained on shaft 34 utilizing a retainer nut 38, although other appropriate means of maintaining flywheel 36 in position may also be utilized.

Figure 2:
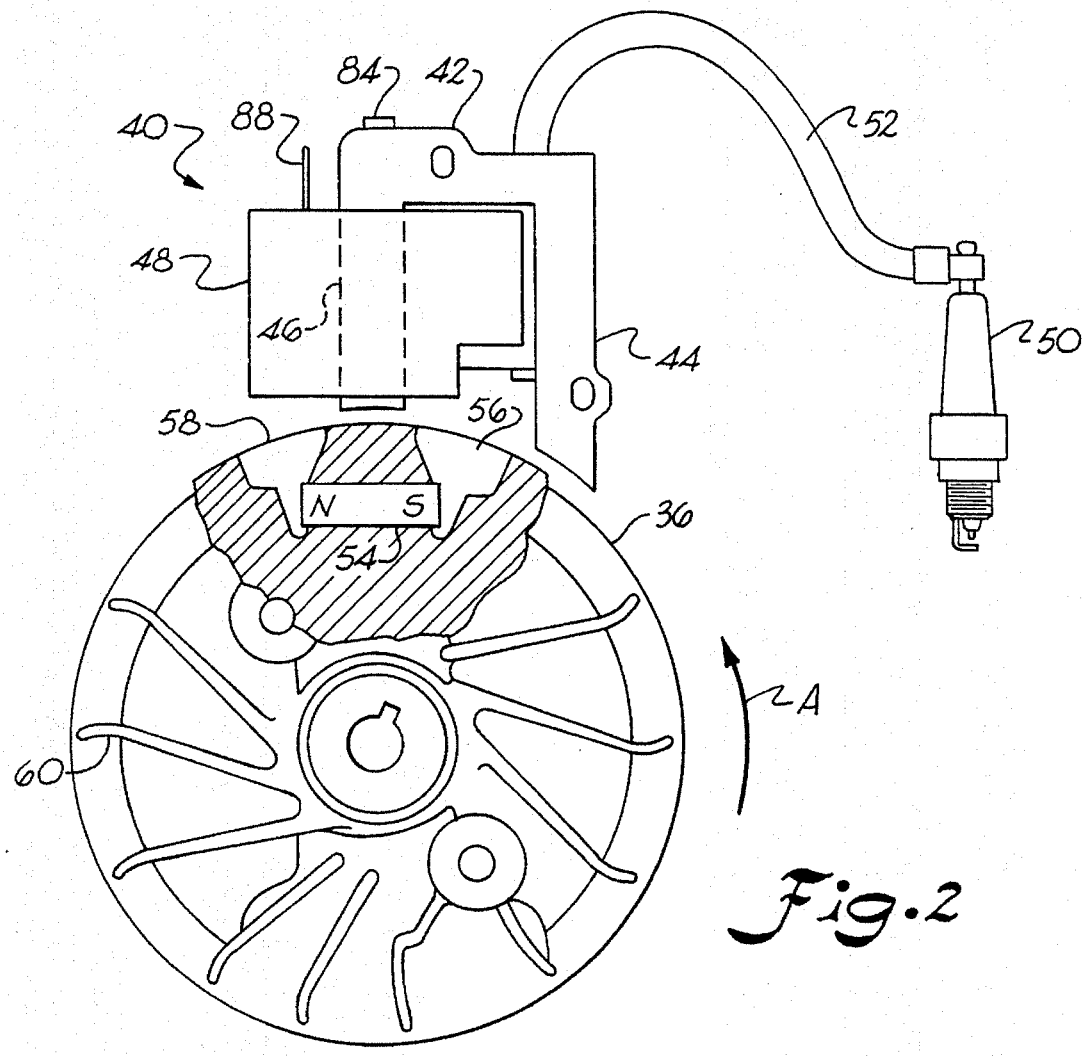
FIG. 2 is an elevational view of various components in a CD ignition system such as may be constructed according to the present invention.

Referring now also to FIG. 2, the engine of chain saw 10 incorporates a CD ignition apparatus to provide the requisite ignition spark. As can be seen, such an ignition apparatus includes a stator unit generally indicated at 40. Stator unit 40 includes a magnetically permeable core 42 having a pair of leg portions 44 and 46. A sealed housing 48 maintains the various coils and other components utilized to produce a spark at spark plug 50. Electrical connection with spark plug 50 is achieved by a typical interconnecting wire 52.

Magnetic flux within core 42 is produced by a magnet assembly which revolves along a circular path in synchronism with operation of the engine. Typically, such a magnet assembly will include a permanent magnet 54 having pole pieces 56 and 58 mounted at respective ends thereof. In a typical application, the magnet assembly is mounted at the periphery of flywheel 36, as shown. Often, this flywheel will also include vane members, such as vane member 60, to circulate cooling air around the engine.

It will be appreciated that rotation of flywheel 36, such as in the direction of arrow A, causes the circumferential faces of pole pieces 56 and 58 to pass proximate the end faces of leg portions 44 and 46. As a result, various voltages are induced in the coils contained within housing 48, as desired.

The present invention provides a CD ignition system having longer spark duration and higher spark energy at lower speeds than the prior art. In order to explain the manner in which the present invention achieves these advantages, it is first helpful to review the operation of a typical prior art CD ignition system. Such a conventional system is schematically illustrated in FIG. 3.

Figure 3:
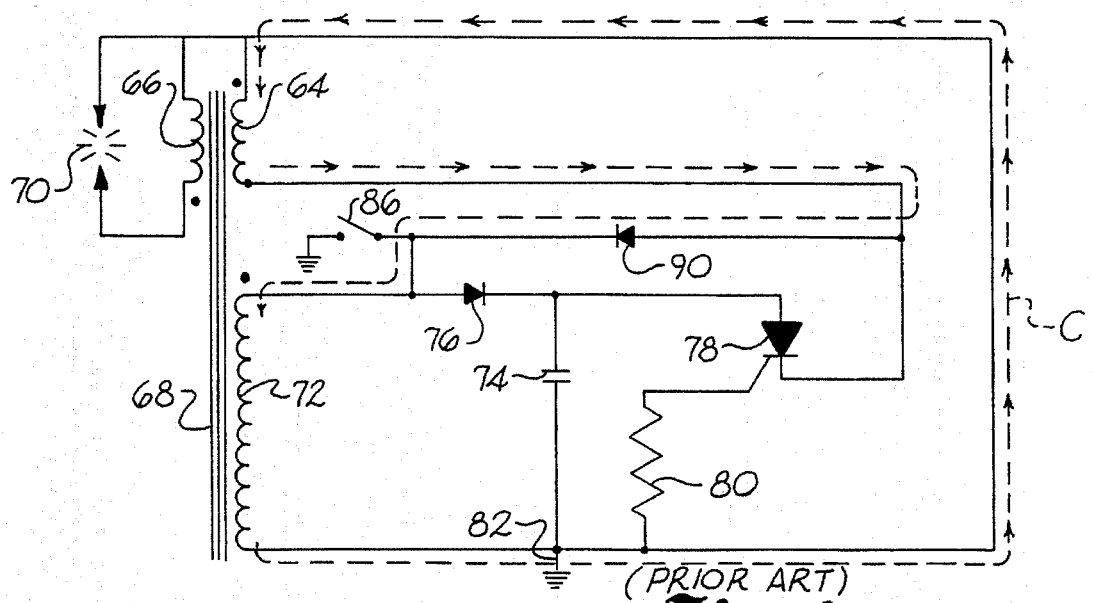
(PRIOR ART) Fig. 3
FIG. 3 is a schematic diagram illustrating a typical CD ignition system constructed according to the prior art.

Thus, referring now to FIG. 3, the illustrated prior art circuit includes a step-up transformer having a primary coil 64 and a secondary coil 66. The magnetically permeable core about which coils 64 and 66 are both wound is indicated at 68. As can be seen, secondary coil 66 is connected across the gap 70 of a typical spark plug.

A charge coil 72 is also situated about core 68. Charge coil 72 is electrically connected to a storage capacitor 74 through a rectifier diode 76. Capacitor 74 is, in turn, electrically connected to primary coil 64 through SCR 78. SCR 78 may be switched "on" by a triggering pulse applied to its gate through resistor 80.

The circuit further includes a floating ground as indicated at 82. Such a ground may be achieved by a tab, such as tab 84 of FIG. 2, which provides electrical communication with the engine block through the core. A stop switch 86 may also be provided to disable operation of the ignition system. The stop switch may be connected via a terminal 88 extending from a top of housing 48, as shown in FIG. 2. A diode 90 provides a return path for current through primary coil 64.

Figure 5:
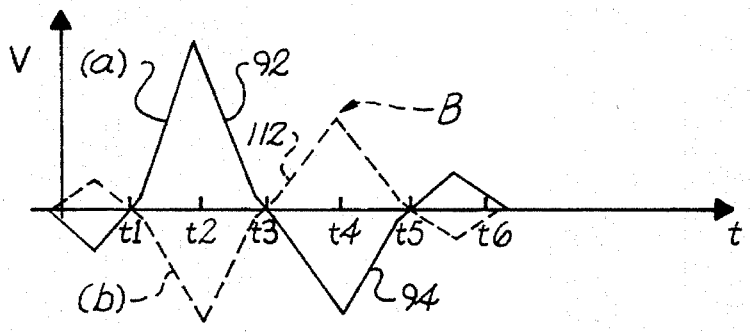
FIG. 5 illustrates a pair of plots respectively showing the charge coil voltage and the secondary coil voltage which may be induced in a CD ignition system by revolution of the magnet assembly.

The operation of the circuit of FIG. 3 may be most easily explained with reference to plot (a) of FIG. 5. Specifically, plot (a) of FIG. 5 illustrates a voltage which may be induced across the charge coil 72. As can be seen, the largest voltage variations occurring across the charge coil appear between time "t1" and "t5." The large positive excursion 92 may be referred to as the first half-cycle voltage, whereas the negative excursion 94 may be referred to as the second half-cycle voltage.

It will be appreciated that diode 76 will conduct during voltage excursion 92, thus allowing a charge to accumulate on capacitor 74. During voltage excursion 94, however, diode 76 will prevent a backflow of current from capacitor 74. At some time shortly after time "t3," the voltage applied to the gate of SCR 78 will exceed the trigger level. When this triggering level is exceeded, SCR 78 will "fire." The charge accumulated on capacitor 74 will then be released as a current through primary coil 64. The predetermined step-up ratio of the transformer produces a higher voltage on secondary coil 66, which is applied across spark gap 70.

Thus, as used herein, the "first half-cycle voltage" is the appreciable voltage excursion across the charge coil during which energy is accumulated on the energy storage element. The "second half-cycle voltage" is the appreciable voltage excursion across the charge coil which follows the "first half-cycle" voltage and during which the electronic switch is triggered. While the "first half-cycle voltage" and the "second half-cycle voltage" are typically opposite in polarity, whether one is considered "positive" or "negative" is simply a matter of convention. Thus, these terms should not be construed as limited to a particular polarity.

Figure 4:
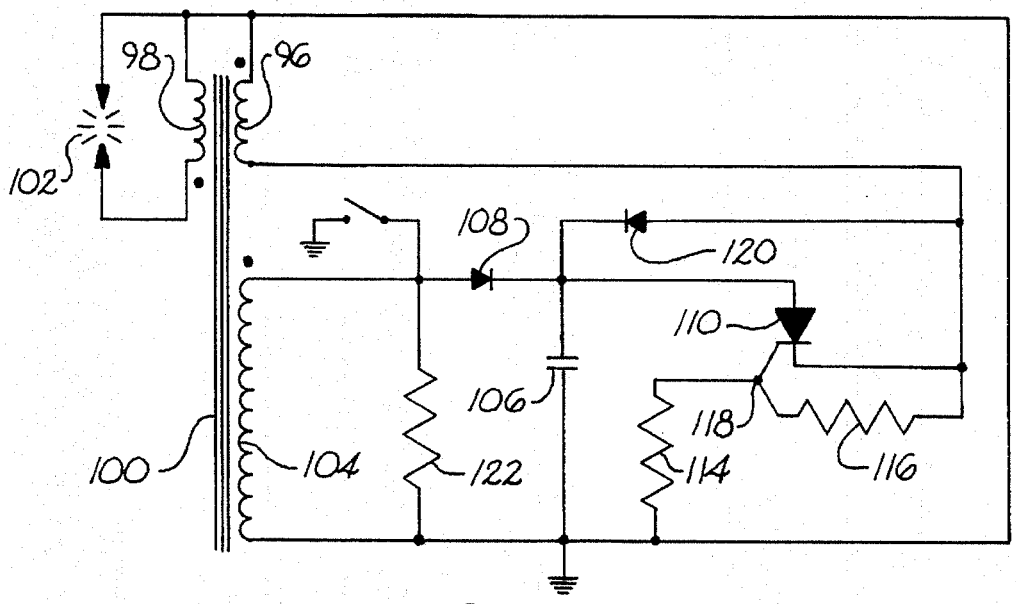
FIG. 4 is a schematic diagram illustrating a CD ignition system constructed according to the present invention.

A schematic of a CD ignition system constructed in accordance with the present invention is illustrated in FIG. 4. It can be seen that many of the components of the circuit of FIG. 4 are similar to the prior art circuit of FIG. 3. For example, the circuit of FIG. 4 utilizes a transformer having a primary coil 96 and a secondary coil 98 situated about a magnetically permeable core 100. Secondary coil 98 is conventionally connected across a spark gap indicated at 102. A charge coil 104 is provided to charge capacitor 106 during the first half-cycle voltage (through rectifier diode 108). An electronic switch, here shown as SCR 110, is provided to release the charge accumulated on capacitor 106 to primary coil 96.

The voltage induced on secondary coil 98 during revolution of the magnet assembly is opposite in polarity to that produced across charge coil 104. It will be appreciated that the voltage induced on charge coil 104 would typically be identical to that produced across charge coil 72 (as shown in plot (a) of FIG. 5). The voltage induced on the secondary coil 98 will also be similar in some respects to that induced across secondary coil 66. Significantly, however, the magnitude of this voltage is increased at certain times during the revolution cycle when compared with the prior art as will be explained.

It can be seen that the secondary coil voltage will experience a positive excursion 112 during the negative excursion 94 of the charge coil voltage. At relatively high engine speeds, the voltage during this period may exceed the sustaining potential in a conventional circuit such as that shown in FIG. 3. The circuit of FIG. 3, however, would not advantageously use this phenomenon, since it is configured to trigger SCR 78 as soon after time "t3" as a triggering signal is applied to its gate. Generally, excursion 112 will not have risen to the level of the sustaining potential by this time.

As described above, however, the '586 patent included a circuit configured to trigger at a time near the peak indicated at B. As a result, a longer spark duration may be achieved at relatively high speeds according to the teachings of the '586 patent. It will be noted, however, that the device of the '586 patent utilizes a trigger coil to provide a timed triggering signal. Such a separate coil may add undesirable expense and complexity to the ignition system.

While a CD ignition apparatus constructed in accordance with the invention may utilize a trigger coil, presently preferred embodiments utilize a voltage divider network to provide a properly timed triggering signal. As shown in FIG. 4, such a voltage divider network may include a first resistor 114 and a second resistor 116 forming a divider node 118. Preferably, resistor 114 will have a resistance value at least three times that of resistor 116. As a result, the voltage at node 118 will be at least three-fourths the voltage across primary coil 96. Divider node 118 is connected to the gate of SCR 110 as shown.

While the above would alone achieve longer spark duration at higher engine speeds, the present invention recognizes that enhancing the magnitude of peak B may achieve longer spark duration at lower engine speeds. Referring again to FIG. 3, it has been appreciated that undesirable current flow through the charge coil has been a significant factor tending to limit the secondary coil voltage. Specifically, when the voltage on charge coil 72 goes negative, current will flow through the path indicated by the dashed arrow C. Because the overall impedance in this path is very low during this period, the current flow will be greater than negligible. As a result, flux is generated in core 68 in opposition to the flux which is inducing excursion 112. The voltage level at peak B will thus be significantly reduced over that which could be produced in the absence of such current.

The circuit shown in the '586 patent suffers from the same deficiency. As can be seen, a diode (referenced as 26) is connected across the charge coil (referenced as 20). This diode will form a low impedance current loop when a voltage opposite the charging polarity is being induced on the charge coil. Current flow in this loop produces a flux tending to reduce the potential induced on the secondary coil (referenced as 18).

Referring again to FIG. 4, the present invention increases the value of peak B by breaking the current loop through charge coil 114 during the period in which SCR 110 is to be switched. In exemplary constructions, this is accomplished by connecting return path diode 120 to the top of capacitor 106, as shown.

A resistor 122 may be advantageously connected across charge coil 104 that permits a negligible current to flow during voltage excursion 112. As a result, the magnitude of the voltage induced on charge coil 104 may be prevented from rising to undesirable levels. For example, it may be desirable to keep the charge coil voltage below a magnitude which could facilitate coil breakdown. In many applications, the value of resistor 122 may fall within a range of 10,000 ohms to 20,000 ohms to keep the voltage level relatively low. In these exemplary constructions, this negligible current will generally be less than 40 milliamperes. This compares with a typical current of approximately 300 milliamperes in a typical application having a circuit such as in FIG. 3. Thus, as used herein, the term "negligible current" indicates a current less than that which would produce a flux sufficient to reduce peak B more than an insubstantial amount.

It has often been deemed desirable in the prior art to utilize a capacitor of a relatively low capacitance in order to permit effective operation at higher engine speeds. Such a small capacitor, however, generally had the undesirable effect of limiting the spark energy at lower speeds (when a larger capacitor could be used to accumulate more charge). Because the present invention relies less on the capacitor to achieve spark energy at higher speeds, a larger capacitor is feasible. In fact, capacitors having a capacitance value of up to a 50 percent or more increase, in comparison with comparable circuits of the prior art, may be utilized. For example, a typical capacitor utilized in a circuit such as that shown in FIG. 3 may have had a value of less than 0.68 microfarads. The present invention would allow a capacitor of at least 1 microfarad to be used in this case, which is approximately a 47 percent increase.

Figure 6A:
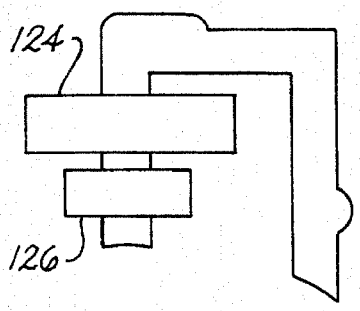
FIGS. 6A and 6B illustrate alternative placements of the various coils in relation to one another on a magnetically permeable core in a CD ignition system constructed according to the present invention.
Figure 6B:
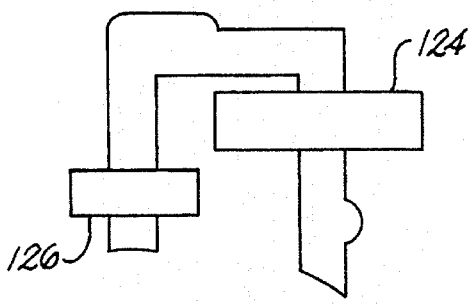

FIGS. 6A and 6B illustrate alternative placements of the various coils situated on a core, such as core 42 of FIG. 2. Generally, it will be desirable to mount the primary and secondary coils of the transformer as close to one another as possible to limit flux losses in the core. Thus, the primary and secondary coils are typically wound as a unit 124.

Due to manufacturing considerations, it will often be desirable to situate charge coil 126 on the same leg of the core as unit 124. The distance, however, between unit 124 and charge coil 126 should be appropriately chosen to reduce the magnetic interaction between these components. Alternatively, charge coil 126 may be mounted on a leg separate from unit 124, as shown in FIG. 6B. This serves to further reduce the magnetic interaction between unit 124 and charge coil 126.

It should be appreciated that modifications and variations of the present inventions may be practiced by those of ordinary skill in the art, without departing from the spirit and scope of the present invention, which is more particularly set forth in the appended claims. In addition, it should be understood that aspects of various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A discharge ignition apparatus for use with an internal combustion engine to produce an electrical spark at a spark ignition device, said apparatus comprising:

a magnet assembly operatively revolved along a circular path in synchronism with operation of the engine, said magnet assembly including a pair of pole faces;

a magnetically permeable core mounted adjacent said circular path and having at least two leg portions each including a respective end face, said leg portions being situated so that said pole faces pass proximate to said end faces during revolution of said magnet assembly;

a discharge circuit including:

(a) an energy storage element;

(b) a charge coil situated about said magnetically permeable core such that a first half cycle charge coil voltage and a second half cycle charge coil voltage are induced thereon during revolution of said magnet assembly;

(c) said discharge circuit being configured to supply electrical energy to said energy storage element during the first half-cycle charge coil voltage and further configured so that no greater than a negligible current flows through said charge coil during the second half-cycle charge coil voltage;

(d) a transformer having a primary coil and a secondary coil situated about said magnetically permeable core, said secondary coil electrically connected during operation to the spark ignition device to produce the electrical spark;

(e) an electronic switch electrically connected between said energy storage element and said primary coil, said electronic switch being nonconductive during the first half-cycle charge coil voltage to allow electrical energy to accumulate at said energy storage element and being rendered conductive by a triggering signal supplied thereto; and (f) triggering circuitry electrically connected to said electronic switch for supplying said triggering signal thereto at a predetermined time during the second half cycle charge coil voltage.

2. An apparatus as set forth in claim 1, further comprising a resistive element electrically connected across said charge coil to conduct no more than said negligible current during the second half-cycle charge coil voltage.

3. An apparatus as set forth in claim 2, wherein said resistive element has a value generally falling within a range of 10,000 ohms to 20,000 ohms.

4. An apparatus as set forth in claim 1, wherein said triggering circuitry includes a voltage divider network electrically connected across said primary coil for producing said triggering signal at a divider node thereof.

5. An apparatus as set forth in claim 4, wherein said voltage divider network is configured to produce a voltage at said divider node which is at least three-fourths of a total voltage across said primary coil.

6. An apparatus as set forth in claim 1, wherein said energy storage element is a capacitive storage element having a value greater than 0.7 microfarads.

7. An apparatus as set forth in claim 1, wherein said discharge circuit is configured having the following component arrangement:

a first side of said primary coil electrically connected to a relative ground potential and a second side of said primary coil electrically connected to a cathode of said electronic switch;

a return path diode having an anode electrically connected to said cathode of said electronic switch and a cathode electrically connected to an anode of said electronic switch;

a rectifier diode having an anode electrically connected to one side of said charge coil and a cathode electrically connected to said anode of said electronic switch; and said energy storage element comprising a storage capacitor connected between said anode of said electronic switch and said relative ground potential.

8. An apparatus as set forth in claim 7, further comprising a resistive element electrically connected across said charge coil to conduct no more than said negligible current during said negative half cycle charge coil voltage.

9. An apparatus as set forth in claim 7, wherein said triggering circuitry includes a voltage divider network electrically connected across said primary coil for producing said triggering signal at a divider node thereof.

10. An apparatus as set forth in claim 9, wherein said voltage divider network is configured to produce a voltage at said divider node which is at least three-fourths of a total voltage across said primary coil.

11. An apparatus as set forth in claim 1, wherein said primary coil and said secondary coil are mounted on a first leg portion of said core and said charge coil is mounted on a second leg portion of said core.

12. A discharge circuit for use in a discharge ignition apparatus of the type operative to produce an electrical spark at a spark ignition device, said apparatus comprising:

(a) a storage capacitor having a first side electrically connected to said relative ground potential;

(b) a charge coil having a plurality of turns, said charge coil having a first side connected to said relative ground potential;

(c) a rectifier diode having an anode electrically connected to a second side of said charge coil and a cathode electrically connected to a second side of said storage capacitor;

(d) a transformer including a primary coil and a secondary coil having a respective plurality of turns defined by a predetermined step-up ratio, said secondary coil electrically connected during operation to the spark ignition device to produce the electrical spark, a first side of the primary coil electrically connected to said relative ground potential;

(e) an electronic switch electrically connected between said second side of said storage capacitor and said second side of said primary coil, said electronic switch being rendered conductive by a triggering signal applied to a gate electrode thereof;

(f) a return path diode having an anode electrically connected to a cathode of said electronic switch and a cathode electrically connected to an anode of said electronic switch; and (g) triggering circuitry electrically connected to said electronic switch for supplying said triggering signal to said gate electrode at a predetermined time.

13. An apparatus as set forth in claim 12, further comprising a resistive element electrically connected across said charge coil.

14. An apparatus as set forth in claim 13, wherein said resistive element has a value falling generally within a range of 10,000 ohms to 20,000 ohms.

15. An apparatus as set forth in claim 12, wherein said triggering circuitry includes a voltage divider network having a divider node electrically connected to said gate electrode of said electronic switch, said voltage divider network connected across said primary coil for producing said triggering signal at said divider node.

16. An apparatus as set forth in claim 15, wherein said voltage divider network is configured to produce a voltage at said divider node which is at least three-fourths of a total voltage across said primary coil.

17. An apparatus as set forth in claim 12, wherein said capacitive storage element has a value greater than 0.7 microfarads.

18. A discharge ignition apparatus for use in an internal combustion engine to produce an electrical spark at a spark ignition device having a characteristic spark ionization potential and a lower characteristic spark sustaining potential, said apparatus comprising:

a movable magnet assembly;

a magnetically permeable core mounted such that said magnet assembly will periodically pass proximate thereto;

a discharge circuit including:

(a) a storage capacitor;

(b) a charge coil situated about said magnetically permeable core such that a charging voltage is induced thereon due to passage of said magnet assembly, said charging voltage producing an accumulation of charge on said storage capacitor;

(c) a transformer having a primary coil and a secondary coil situated about said magnetically permeable core and having a predetermined step-up ratio, said secondary coil electrically connected during operation to the spark ignition device to produce the ignition spark;

(d) an electronic switch electrically connected between said energy storage element and said primary coil, said electronic switch being nonconductive as said charge is accumulated on said storage capacitor and being rendered conductive by a triggering signal;

(e) triggering circuitry electrically connected to said electronic switch for supplying said triggering signal thereto at a predetermined time; and (f) said discharge circuit being configured such that no greater than a negligible current will flow through said charge coil at the predetermined time and a period immediately thereafter during which a voltage no less than the spark sustaining potential is being induced across said charge coil.

19. An apparatus as set forth in claim 18, further comprising a resistive element electrically connected across said charge coil to conduct no more than said negligible current.

20. An apparatus as set forth in claim 19, wherein said resistive element has a value generally falling within a range of 10,000 ohms to 20,000 ohms.

21. An apparatus as set forth in claim 18, wherein said triggering circuitry includes a voltage divider network electrically connected across said primary coil for producing said triggering signal at a divider node thereof.

22. An apparatus as set forth in claim 21, wherein said voltage divider network is configured to produce a voltage at said divider node which is at least three-fourths of a total voltage across said primary coil.

23. An apparatus as set forth in claim 18, wherein said storage capacitor having a value greater than 0.7 microfarads.

24. An apparatus as set forth in claim 18, wherein said discharge circuit is configured having the following component arrangement:

a first side of said primary coil electrically connected to a relative ground potential and a second side of said primary coil electrically connected to a cathode of said electronic switch;

a return path diode having an anode electrically connected to said cathode of said electronic switch and a cathode electrically connected to an anode of said electronic switch;

a rectifier diode having an anode electrically connected to one side of said charge coil and a cathode electrically connected to said anode of said electronic switch; and said storage capacitor connected between said anode of said electronic switch and said relative ground potential.

25. An apparatus as set forth in claim 24, further comprising a resistive element electrically connected across said charge coil to conduct no more than said negligible current during said negative half cycle charge coil voltage.

26. An apparatus as set forth in claim 24, wherein said triggering circuitry includes a voltage divider network electrically connected across said primary coil for producing said triggering signal at a divider node thereof.

27. An apparatus as set forth in claim 26, wherein said voltage divider network is configured to produce a voltage at said divider node which is at least three-fourths of a total voltage across said primary coil.

28. A gasoline engine powered device, such as a chain saw, string trimmer and the like, said device comprising:

a gasoline engine having a drive shaft;

a flywheel operatively connected to said drive shaft for rotation during operation of said gasoline engine, said flywheel including a magnet assembly having at least two pole faces located at a periphery of said flywheel;

a spark ignition device mounted during operation to said gasoline engine;

a discharge ignition apparatus including a magnetically permeable core mounted adjacent the circular path and having at least two leg portions each including a respective end face, said leg portions being situated so that said pole faces pass proximate to said end faces during revolution of said magnet assembly;

a discharge circuit including:

(a) an energy storage element;

(b) a charge coil situated about said magnetically permeable core such that a first half cycle charge coil voltage and a second half cycle charge coil voltage are induced thereon during revolution of said magnet assembly;

(c) said discharge circuit being configured to supply electrical energy to said energy storage element during the first half-cycle charge coil voltage and further configured so that no greater than a negligible current flows through said charge coil during the second half-cycle charge coil voltage;

(d) a transformer having a primary coil and a secondary coil situated about said magnetically permeable core, said secondary coil electrically connected during operation to the spark ignition device to produce the ignition spark;

(e) an electronic switch electrically connected between said energy storage element and said primary coil, said electronic switch being nonconductive during the first half-cycle charge coil voltage to allow electrical energy to accumulate at said energy storage element and being rendered conductive by a triggering signal at a predetermined time during the second half cycle charge coil voltage; and (f) triggering circuitry electrically connected to said electronic switch for supplying said triggering signal thereto at the predetermined time.

* * * * *